US005215433A

United States Patent [19]

Weiland et al.

[11] Patent Number: 5,215,433

[45] Date of Patent: Jun. 1, 1993

[54] AXIAL FAN

[75] Inventors: Heinz Weiland, Waldenburg; Helmut Fuchs; Ulrich Ackermann, both of Schönbuch; Andreas Jacobs, Aschendorf; Joachim Mohr, Pforzheim, all of Fed. Rep. of Germany

[73] Assignee: Gebhardt Ventilatoren GmbH & Co., Fed. Rep. of Germany

[21] Appl. No.: 883,805

[22] Filed: May 13, 1992

Related U.S. Application Data

[63] Continuation of Ser. No. 571,044, Aug. 22, 1990, abandoned.

[30] Foreign Application Priority Data

Aug. 23, 1989 [DE] Fed. Rep. of Germany ..... 3927791

[51] Int. Cl.[5] ..... F04D 29/66

[52] U.S. Cl. ..... 415/119; 415/914

[58] Field of Search ..... 415/186, 187, 193, 208.2, 415/208.3, 119, 914

[56] References Cited

U.S. PATENT DOCUMENTS

| | | | |
|---|---|---|---|
| 2,028,985 | 1/1936 | Mahon | 415/119 |
| 3,128,973 | 4/1964 | Dannenberg | 415/914 |
| 3,346,174 | 10/1967 | Lievens et al. | 415/119 |
| 3,948,346 | 4/1976 | Schindler | 415/119 |
| 3,976,393 | 8/1976 | Larson | 415/208.2 |
| 4,692,091 | 9/1987 | Ritenour | 415/193 |

*Primary Examiner*—Edward K. Look
*Assistant Examiner*—Michael S. Lee
*Attorney, Agent, or Firm*—Edgar A. Zarins; Malcolm L. Sutherland

[57] ABSTRACT

An axial fan has an impeller provided with vanes and mounted in a flow duct. In or on the wall of the duct at least one port is arranged adjacent to the vane tips. The duct side the port is provided with a covering means having passages therethrough.

19 Claims, 2 Drawing Sheets

AXIAL FAN

This is a continuation of copending application 07/571,044 filed on Aug. 22, 1990, now abandoned.

BACKGROUND OF THE INVENTION

I. Field of the Invention

The invention relates to an axial flow fan of the type comprising an impeller bearing vanes and arranged in a duct surrounded by a wall.

II. Description of the Prior Art

In the interior of their housings axial flow fans possess a vaned impeller which is rotated by a motor. The rotating impeller pumps a gaseous fluid, more particularly air, in the axial direction from the input end to the output end of the housing. The rate of flow per unit time, known as the volumetric flow V, depends upon, among other factors, on the speed of rotation of the impeller.

The operational characteristics of known axial flow fans become irregular with increased throttling of the volumetric flow. When a certain machine-dependent minimum value is reached, the flow starts to stall in the fan. As a consequence there is a rotating detached flow referred to as rotating stall. The separation of the flow along the vane contour, which commences when there is a considerable decrease in the flow velocity, does not occur simultaneously with all vanes. Initially a sort of separation zone comes into being on the upstream vane side. The resulting dead space is characterized by intensive internal vortices, which result in a considerable loss in energy. Blockage of the passage resulting from the separation causes the flow to be deflected and when a certain critical volumetric flow is reached, the so-called stalling point, individual channels suddenly become blocked. Because this affects the flow towards adjacent vanes, the intervane channels in which the flow is impeded cause the flow to relatively move around the impeller in a direction opposite to the actual direction of rotation. As a result, a heavily pulsating flow is created whereby smooth operation in this instable range is impossible. In extreme cases, the high flexural and alternating flexural forces lead to damage to the impeller and of components operated in conjunction with the fan. In the respective partial load range, the performance curve of the axial flow fan is characterized by a sudden loss in pressure. The operation of the fan in the critical range can be extremely noisy.

Because commencement of the instable operating range is typically only a small distance from the optimum operating point, prior known designs to correct these deficiencies had to be particularly thorough and therefore expensive.

The German patent publication 3,322,295 A has proposed a solution to this problem in which there is an additional annular vaned duct which is to receive the separated flow and the momentum thereof and to cause stabilization. However such a design may only be readily applied to a limited range of conceivable impeller geometries. It is extremely difficult to optimize the vane arrangement in the annular duct, which in any case leads to a substantial increase in price of the fan.

SUMMARY OF THE PRESENT INVENTION

Accordingly, one object of the present invention is to provide an axial flow fan wherein the "rotating stall" or separated flow is effectively eliminated in a simple manner such that stability is created over the entire volumetric flow range. Furthermore, the measures adopted for attaining this object are to be simple to apply to any type of axial flow fan and axial flow compressors.

In order to achieve these or other objects described in the present specification, claims, and drawings, the axial fan of the present invention includes at least one recess adjacent to the respective vane tips provided on the duct side with a covering, creating passages. In place of the conventional smooth wall surface of the flow duct containing the impeller of the axial flow compressor there is now a flow duct wall provided with at least one recess adjacent to the vane tips. It may for instance be in the form of a recess extending from the flow passageway into the wall. In the flow duct, the recess may be covered over by a cover means having openings therethrough. The consequence of the design, in accordance with the invention, is an extremely constant form of operating characteristic, which is independent of the intensity of the throttling effect produced in the prior known cases. Even in the case of very low volumetric flow levels, rotating stalls are prevented. In this respect, the added expense involved by a fan in accordance with the present invention is relatively small as compared with a conventional fan. The structural modifications can be produced economically and may be applied to any type of axial flow fan. Complex design work is not required and there is the advantage that the port may be completely free of vanes. Owing to the prevention of stalled flow the amount of noise produced is decreased substantially, more particularly in the operational range which has so far been critical. The invention may be applied with equal advantage both to single stage and also to multistage fans and compressors.

Further developments and features of the invention are covered by the claims.

It has proven to be particularly advantageous to provide a continuous recess extending about the periphery of the impeller and which is designed in the form of an annular gap or annular duct. It is furthermore particularly expedient to design the covering means in the form of a combination made of a coarse covering material and a fine covering material. The two covering materials are best arranged adjacently and more particularly placed in adjacent contact so that a sandwich-like structure results. The coarse cover material is preferably adjacent to the flow duct, whereas the fine cover material is placed radially outwardly thereof within the recess. A particularly successful cover combination is one in which the coarse cover is a piece of perforated sheet metal and the fine cover is fine gauze or fabric.

The preferred breadth of the enlarged annular duct is approximately 20 to 30% of the diameter of the impeller and more particularly 25% thereof. The depth of the annular duct is preferably dependent on the outline of the annular duct. If the annular duct is made in the form of a cylinder, it is advantageous to make the depth of the recess approximately 0.1 to 0.5 times the diameter of the impeller. Other outlines or configurations of the annular duct may be expedient as for instance a rectangular or a square one. In this case the depth of the duct will preferably approach 0.2 times the diameter of the impeller. In the limiting case the length of the side of the square is equal to the diameter of the flow duct so that conceptually there is no continuous annular duct but only four individual recesses which are respectively placed opposite to each other in pairs and more particularly have two surfaces running at right angles to each other. Other outlines or configurations of the recesses are also possible particularly recesses with round or rounded wall portions.

The relative axial position of the impeller and the associated wall recess is able to be varied from case to case. It is an advantage if the impeller, as considered in the direction of flow, is axially partly past the annular recess. A degree of overlap of approximately 50% is expedient in this respect.

The invention also contemplates the possibility of modifying existing fans so as to embody it. For this purpose, it is possible to cut ports in the wall, for instance, surrounding the flow duct or, respectively, the fan housing adjacent to the vane tips, the created recess then being covered over by the fine cover means and the further, outer housing cover means. Such outer covered means may also be arranged to serve the purpose of acting as support feet of the housing.

Further features and advantages of the invention will be gathered from the ensuing detailed description of several embodiments thereof referring to the drawings.

BRIEF DESCRIPTION OF THE DRAWINGS

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF WORKING EMBODIMENTS OF THE INVENTION

Figure 1:
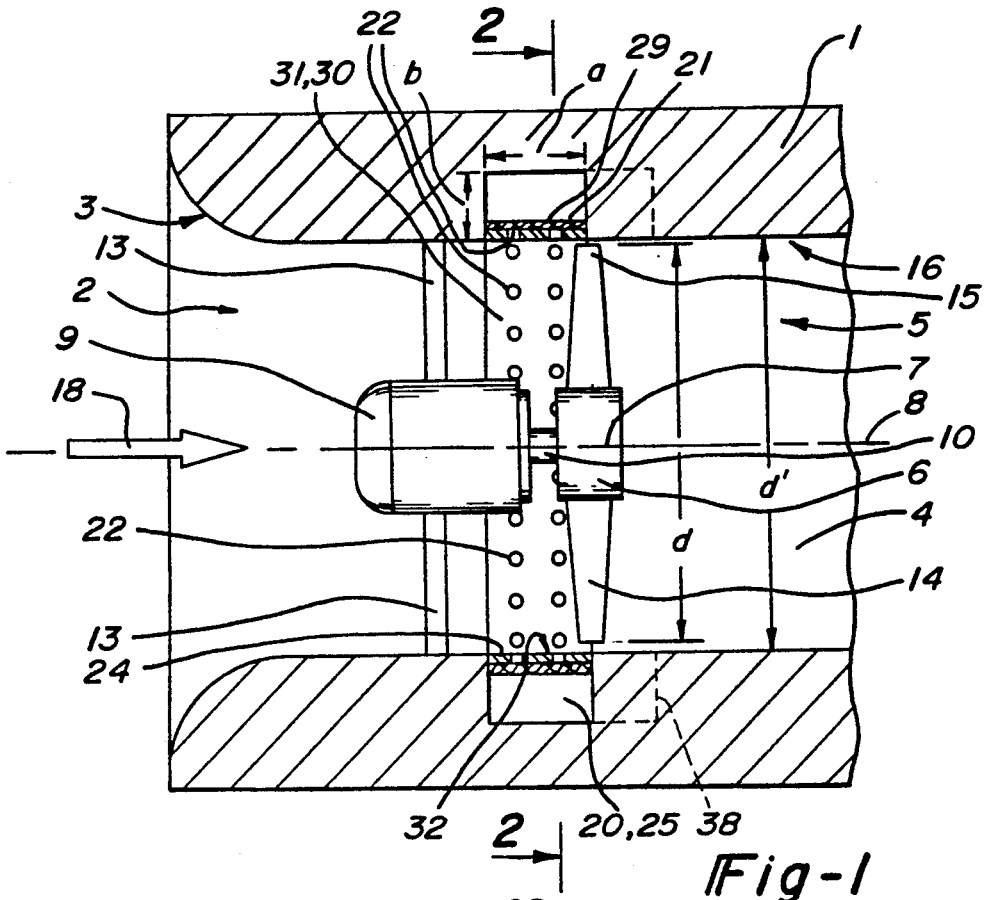
FIG. 1 shows a first possible design of the axial flow fan in accordance with the invention as seen in a diagrammatic longitudinal section.
Figure 2:
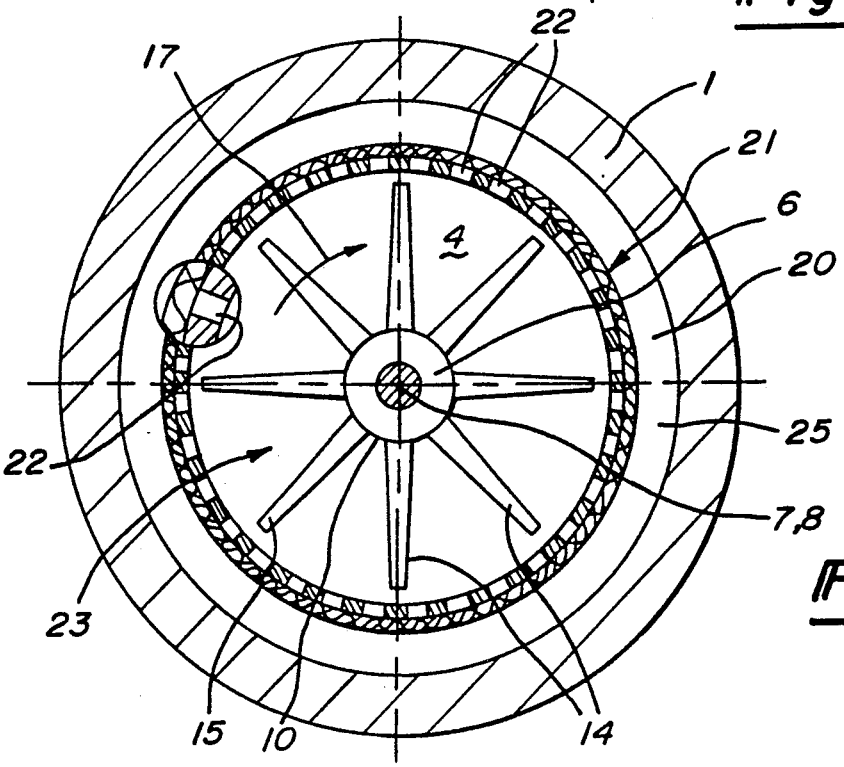
FIG. 2 represents a cross-section taken through the fan of FIG. 1 on the section line II—II.

Turning initially to the FIGS. 1 and 2 showing a partial diagrammatic view of an axial flow fan, the reader will firstly see a tubular or hollow cylindrical wall 1, which may for instance simultaneously serve as the fan housing. On the inlet or suction side 2 it is funnel-shaped with the formation of an inlet nozzle 3.

The wall 1 defines a flow duct 4. In this duct 4 there is, between the suction end 2 and the axially following pressure end 5, a fan impeller 6. It is able to revolve about its longitudinal axis 7, which coincides with the longitudinal axis 8 of the duct. The impeller 6 is driven by means of a prime mover 9 in the form of an electric motor connected to the impeller 6 on the motor shaft 10.

The motor 9 is preferably also arranged coaxially in the flow duct 4, it being supported therein on the wall 1, for instance by means of radial struts 13, which are indicated diagrammatically.

The impeller 6 comprises a plurality of circumferentially distributed vanes 14. The tips 15 of the vanes are positioned in proximity to the cylindrically formed inner surface 16 of the wall 1 with a radial space. During operation, the impeller 6 is rotated by the motor, as indicated by the arrow 17 so there is an axial flow of gas, typically air, from the inlet end 2 to the pressure or outlet end 5.

In order to prevent the rotating stall phenomenon, which may also be referred to as a rotating separated flow, at least one recess 20 is provided in or on the wall 1 proximate to the vane tips 15. In the direction towards the flow duct 4, that is to say the recess opening on the duct side, the recess is provided with a cover means 21. The cover 21 is provided with a plurality of apertures or passages 22 so that there is a fluid communication between the recess 20 and the flow duct 4.

This feature ensures that even in operational phases with a heavy throttling of the volumetric flow, the vanes 14 are swept by the flow in a manner practically free of separation. In this respect, the flow cross sections available for the flow of the fluid (air) therethrough in the individual vane channels, i.e., channels between the two circumferential adjacent vanes, remain constant and do not experience any deterioration of the cross section. Even in the case of a stronger throttling effect, the operational characteristics are constant and there is no alternate loading of the components of the impeller and there is no nuisance caused by noise. As a result, the working life of the axial flow fan is increased to a substantial extent. The efficiency is also enhanced owing to the absence of flow interruption.

Figure 6:
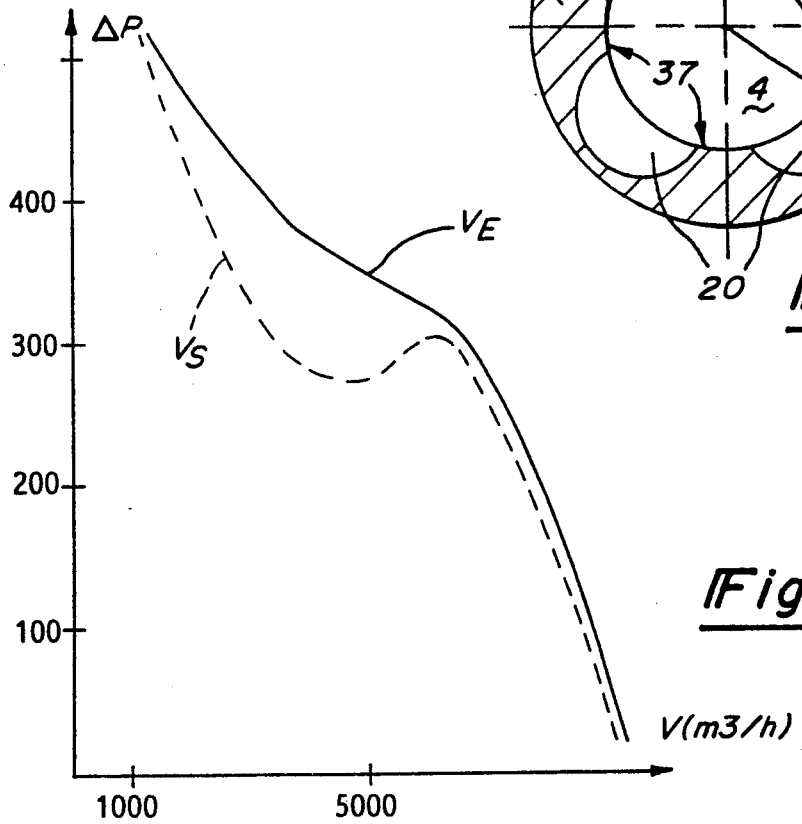
FIG. 6 is a graph to compare a fan in accordance with the invention and a further fan in accordance with the state of the art.

FIG. 6 shows the characteristic curve Vs of a fan in accordance with the prior art (plotted in broken lines) for comparison with the characteristic Ve of the fan in accordance with the invention. The increase in pressure p is plotted along the vertical axis whereas the volumetric flow V is plotted along the horizontal axis. It is possible to clearly see the drop in pressure with a fall in the volumetric flow in the case of the prior art fan, while the characteristic of the fan in accordance with the present invention is stable in this range as well as being stable in the rest of the range.

Reverting again to FIGS. 1 and 2 it will be seen that the recess 20 and its opening 24 towards the flow duct 4 extend preferably at least along part of the wall 1 in the circumferential direction thereof. In comparison to other working embodiments of the invention to be described infra, the recess preferably extends over the entire circumference of the wall so that it practically coaxially surrounds the flow duct 4. It is thus possible to refer to it as an annular duct 25.

The annular duct 2 illustrated is of simple configuration and represents a sort of cut-out about the entire circumference of the duct and extending from the inner surface 16 into the wall 1. It is thus relatively cheap to produce. Its lengthwise cross sectional form is shown in FIG. 1 and is preferably rectangular, as for instance square. It is however also possible to have a rounded cross sectional form, as for example a circular section, possibly with a flat or flattened part adjacent to the opening 24. Such designs of the cross section are possible in each form of the recess 20.

Figure 3:
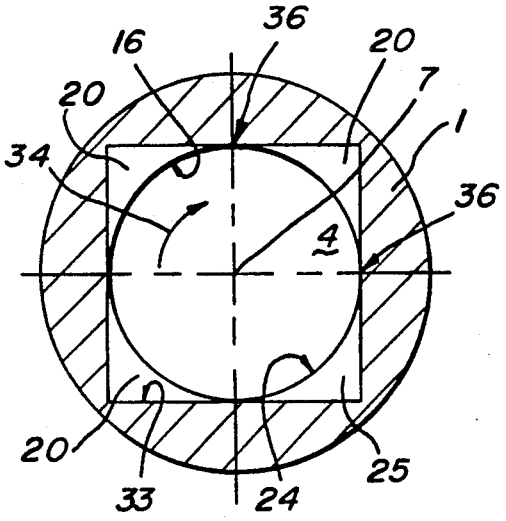
FIGS. 3 to 5 are also diagrammatic views of further possible axial flow fans in accordance with the invention omitting the impeller.

The depth b measured in the radial direction of the annular duct 25, which in the case of the embodiment shown in FIGS. 1 and 3 is a cylindrical annular duct 25, is constant along the entire circumference and preferably amounts to 0.1 to 0.2 times the diameter d of the impeller 6 or of the diameter d' of the flow duct 4.

While in the case of all the embodiments, the recess 20 is formed into the wall 1, in the case of other possible forms of the invention it may be provided externally on the wall and be enclosed by additional means. It is also to be noted that the wall does not have to be directly formed by a housing and it may be in the form of an additional part arranged in the fan, which is subsequently placed in the fan duct properly so called. The only important point is that a means is provided in the circumferential part of the impeller, which delimits or defines a recess having an opening.

The cover means 21 preferably comprises a first cover material 29 having a plurality of fine or fine-pored passages 22. The first covering material 29 may more particularly be a piece of fabric which, as in the working embodiment is in the form of gauze or wire fabric.

The use of woven material as a covering material, or as a portion of such covering means, offers the advantage of maintaining a large number of very small openings or passages, as are present in a sieve-like fabric. The type of weave and the mesh size of the fabric will be selected in accordance with the specific requirements.

As an alternative to the fine covering material 29, the covering means 21 may also be a coarse covering material 30. However, it has turned out to be a particular advantage to use a covering means 21, which combines both a first covering material 29 with a tight weave as well as a second covering material 30. In the working example of FIGS. 1 and 2 this is in fact the case.

The second covering material 30 comprises a plurality of large passages or holes 22 and is preferably in the form of a piece of perforated sheet metal. It may for instance be in the form of a tubular or hollow cylindrical covering band 31, which has the holes 22. They may be in an irregular array or more preferably in a regular array. They will more particularly be distributed along the circumference of the second covering material 30, which is preferably arranged so as to be coaxial to the flow duct.

In the working example the second covering material 30 and the first covering material 29 are arranged adjacently in the radial direction in relation to the longitudinal axis 7 and 8. The two covering materials 29 and 30 are practically in the form of bands and form a thin-walled, tubular structure. They are arranged coaxially to each other. As seen in section there is thus a sandwich-like structure, as will be seen from the enlarged view of FIG. 2. Although the two annular structures may be arranged with a distance between them, it is nevertheless possible to have them in contact with each other. It is preferable for the second covering material 30 to be covered or coated with the tight weave first covering material 29. It has proven to be a particular advantage to so select the sequence of the arrangement that the coarse second covering material 30 is adjacent to the flow duct 4, while the fine first covering material 29 is arranged adjacent to the recess on the radially outer side, remote from the flow within the flow duct.

It is best for the covering means 21 to be arranged adjacent to the opening 24 of the respective recess 20. As a result it constitutes a means dividing the recess 20, more especially delimited by parts of the wall 1. In order to minimize undesired effects on the flow 18 it is possible for the covering means 21 to be arranged so that it is sunk into the respective recess 20, more particularly in such a manner that the surface 32 of the covering means on duct side runs flush with the inner surface 16.

The manner of attachment of the covering means 21 within the recess 20 is not shown in detail in the figures. However, it will be clear that in case of need suitable attachment means may be provided. For servicing it is an advantage if the covering means 21 is attached in a replaceable manner, more especially on the wall 1.

In lieu of the circular annular form as in the working example of the invention shown in FIGS. 1 and 2, the annular duct 25 may also have a polygonal circumferential form. In this respect attention is directed to FIG. 4, in which the annular duct 25 as seen in the axial direction 7 and 8 of the impeller 6 or, respectively, of the flow duct 4 has a polygonal outer form 33. In this respect it is an advantage if the shape is in the form of a regular polygon as for instance a quadrilateral. In the illustrated, preferred working example the outer shape 33 of the annular duct 25 conforms to a rectangle so that the depth, as measured in the radial direction, varies with respect to the duct as indicated by the arrow 34. The duct 25 is in the form of a space, which is delimited by the faces of a parallelopipedon at the outer circumference and at the two axial sides, whereas the limit at the inner circumference is the cylindrical surface of the central duct.

In the special case illustrated in FIG. 3 the outer form 33 of the duct 25 has a square form. However, the contour lines are locally extended tangentially towards the inner periphery 16 of the flow duct 4 so that in the strict sense of the words there is no annular duct. In fact, it is rather a question of a plurality of individual recesses 20 circumferentially spaced about the duct 4, adjacent recesses 20 being separated from each other by the contact parts between the outer face 33 and the internal periphery 16. Respective separating parts are indicated at 36 in FIG. 3.

In the working embodiment of the invention shown in FIG. 3 four individual recesses 20 are present, which are placed respectively diametrally opposite to each other. As seen in cross section in FIG. 3, the recess 20 has a triangular form, the side adjacent to the flow duct 4 being rounded in accordance with the radius thereof.

Dependent on the outer periphery of the "annular duct" it is also possible for more or less individual recesses to be produced.

The depth of the annular duct 25, as indicated in FIG. 3, varies along its circumference 34. It is an advantage if the values for the depth are within a range between 0 and 0.2 times the diameter of the impeller or the diameter of the flow duct.

Irrespective of the working embodiment in question it is an advantage if the breadth a, as measured in the axial direction 7 of the impeller 6, of the annular duct is equal to between 0.2 and 0.3 times the diameter d of the impeller or times the diameter d, of the flow duct. Preferably the depth amounts to 25% (0.25) of the diameter d or d'.

Figure 5:
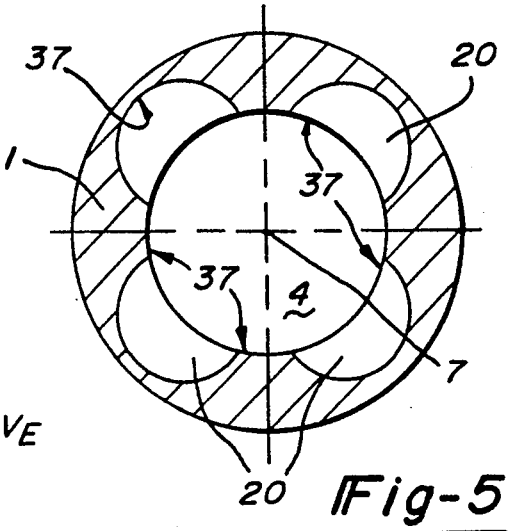

In the working embodiment of FIG. 5 there is no continuous annular duct. In this case there are, as in the embodiment of FIG. 3, several individual recesses 20 distributed along the circumference of the impeller 6 in the wall 1. There is the departure from the working example of FIG. 3 the wall parts 38 devoid of ports are larger as measured in the peripheral direction of the flow duct 4. The individual recesses 20 are thus markedly offset from each other. Furthermore, the outline 37 of the recesses 20 represents a continuous, round surface, more particularly with a circular curvature.

In all embodiments of the invention identical or functionally corresponding parts are marked with identical reference numerals. The words "outer shape" or "outline" used herein refers to the part which is outer in relation to the longitudinal axis 7 and 8.

The at least one recess 20 is preferably arranged in a diametral plane, which coincides with that of the impeller 6. Such an arrangement is indicated in FIG. 1 at 38 by broken lines. In preferred forms of the invention the impeller is however offset in the axial downstream direction from the diametral plane of the associated recess 20. In the working example of FIGS. 1 and 2 the impeller 5 and, respectively, the vane tips 15 is or are at least in part adjacent to the recess 20. Thus the impeller 5 is in part axially downstream of the recess 20 and, respectively, downstream of the annular duct 25.

In this case it is best for it to be located in the input end part of the recess 20, i.e., on the pressure side thereof. A preferred value which has been found is such that the degree of overlap corresponds to 50% of the impeller being aligned with the recess and 50% downstream of the recess.

Figure 4:
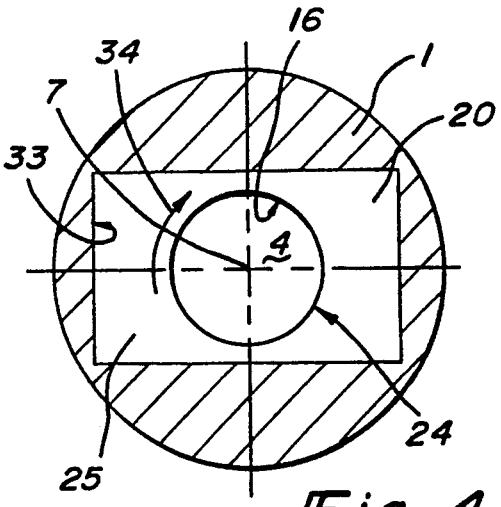

In the working embodiment shown in FIGS. 3 through 5 the covering means of the recesses 20 are omitted to simplify the drawing. The design may be the same as in FIGS. 1 and 2. Dependent on whether there is one annular duct or individual openings it is possible to provide entire, annular covering means or individual covering means. The covering means may also be formed without any openings, the passages only being formed by a suitable shape of the covering means cooperating with the surrounding parts, i.e., the wall 1.

The foregoing detailed description has been given for clearness of understanding only and no unnecessary limitations should be understood therefrom as some modifications will be obvious to those skilled in the art without departing from the scope and spirit of the appended claims.

We claim:

1. An axial flow fan comprising:

a housing wall forming a flow duct and having a rotatable impeller with a plurality of vanes positioned therein;

a plurality of recesses formed in said housing wall circumferentially spaced about said wall proximate said impeller vanes; and covering means having at least one passageway covering said recesses, said at least one passageway providing fluid communication between said recesses and said duct.

2. The axial flow fan as defined in claim 1 wherein said housing wall includes four recesses arranged in diametrically opposed pairs in relation to the rotational axis of said impeller.

3. The axial flow fan as claimed in claim 1 wherein the outline of said recesses is semi-cylindrical.

4. The axial flow fan as defined in claim 1 wherein the outline of said recesses is polygonal.

5. An axial flow fan comprising:

a housing wall forming a flow duct and having a rotatable impeller with a plurality of vanes positioned therein;

at least one recess formed in said housing wall proximate said impeller vanes, said at least one recess including an opening into said flow duct; and means of covering said opening of said at least one recess separating said at least one recess from said flow duct, said covering means mounted in said opening flush with said housing wall forming a hollow cavity within said at least one recess and permitting fluid therethrough to provide fluid communication between said hollow cavity within said at least one recess and said flow duct.

6. The axial flow fan as defined in claim 5 wherein said covering means includes a first covering material, said first covering material allowing fluid communication between said flow duct and said recess.

7. The axial flow fan as defined in claim 6 wherein said first covering material is porous to allow fluid communication therethrough.

8. The axial flow fan as defined in claim 6 wherein said first covering material is a fabric.

9. The axial flow fan as defined in claim 6 wherein said first covering material is a gauze.

10. The axial flow fan as defined in claim 6 wherein said covering means includes a second covering material, said second covering material having a plurality of apertures allowing fluid communication between said flow duct and said recess.

11. The axial flow fan as defined in claim 10 wherein said second covering material is a sheet of perforated metal.

12. The axial flow fan as defined in claim 10 wherein said first and second covering materials are mounted over said cavity in said at least one recess in adjacent flush arrangement, said second covering material positioned adjacent to said cavity.

13. The axial flow fan as defined in claim 12 wherein said at least one recess is a single cylindrical recess extending circumferentially around said flow duct, said cylindrical recess isolated by said first and second covering materials.

14. The axial flow fan as defined in claim 5 wherein the depth of said cylindrical recess is at least 0.1 times the diameter of said impeller.

15. The axial flow fan as defined in claim 12 wherein said at least one recess is a single quadrilateral recess with a four-sided outline.

16. The axial flow fan as defined in claim 15 wherein at least two sides of said quadrilateral recess tangentially align with said housing wall forming a plurality of recesses.

17. The axial flow fan as defined in claim 12 wherein said at least one recess is axially offset in relation to said impeller, said impeller positioned at least partially downstream of said at least one recess within said duct.

18. The axial fan as defined as in claim 17 wherein at least one-half of said impeller is positioned downstream of a downstream edge of said at least one recess, the remainder portion of said impeller vanes being coaxially aligned with said at least one recess.

19. An axial flow fan comprising:

a housing wall forming a flow duct and having a rotatable impeller with a plurality of vanes positioned therein, said vaned impeller having a predetermined length;

at least one recess formed in said housing wall proximate said impeller vanes, said impeller positioned within said duct such that a portion of said impeller's length is downstream of said at least one recess; and means for covering said at least one recess separating said at least one recess from said flow duct, said covering means providing fluid communication between said flow duct and said at least one recess and including a first covering material and a second covering material having a plurality of apertures, said second covering material positioned radially inwardly of said first covering material.

* * * * *